US007413705B2

(12) United States Patent
Agarwal et al.

(10) Patent No.: US 7,413,705 B2
(45) Date of Patent: Aug. 19, 2008

(54) ROSE-COLORED GOLD ALLOY COMPOSITIONS WITH REVERSIBLE HARDNESS CHARACTERISTICS

(75) Inventors: Dwarika P. Agarwal, Attleboro, MA (US); Grigory Raykhtsaum, Sharon, MA (US)

(73) Assignee: Leach & Garner Company, North Attleboro, MA (US)

( * ) Notice: Subject to any disclaimer, the term of this patent is extended or adjusted under 35 U.S.C. 154(b) by 649 days.

(21) Appl. No.: 11/124,935

(22) Filed: May 9, 2005

(65) Prior Publication Data

US 2006/0251539 A1 Nov. 9, 2006

(51) Int. Cl.
*C22C 5/02* (2006.01)

(52) U.S. Cl. ..... 420/511; 148/430

(58) Field of Classification Search ..... 420/511; 148/430

See application file for complete search history.

(56) References Cited

U.S. PATENT DOCUMENTS 5,384,089 A * 1/1995 Diamond ..... 420/511
6,676,776 B1 * 1/2004 Agarwal et al. ..... 148/430

FOREIGN PATENT DOCUMENTS

| | | |
|---|---|---|
| JP | 63-169344 | * 7/1988 |
| JP | 63169344 | * 7/1988 |
| JP | 63-259042 | * 10/1988 |
| JP | 63259042 | * 10/1988 |

OTHER PUBLICATIONS

Is 24K gold pure? posted Nov. 16, 2001, Retrieved from the internet:<URL:http://www.sciam.com/print_version.cfm?articleID=0009644A-594D-1C72-9EB7809EC588F2D7.*

* cited by examiner

*Primary Examiner*—Sikyin Ip
(74) *Attorney, Agent, or Firm*—Phillips Lytle LLP

(57) ABSTRACT

Improved 14-karat rose-colored gold alloy compositions include: about 58.5% gold; about 9.0-12.0% silver; about 0.0-0.2% zinc; about 0.3-0.4% cobalt; about 0.0-0.02% iridium; and about 29.0-33.0% copper. Improved 18-karat rose-colored gold alloy compositions include: about 75.2% gold; about 7.0% silver; about 0.0-0.2% zinc; about 0.3-0.4% cobalt; about 0.0-0.02% iridium; and about 17.0-17.5% copper. The hardness of these compositions are capable of being selectively changed between their respective annealed-hardness and age-hardness values. The color of these compositions is between about 5-7 CieLab a* color units and between about 17-21 CieLab b* color units.

6 Claims, 4 Drawing Sheets

Table No. 1

| Alloy No. | Composition | | | | | Color | | | Hardness (VHN) | | Melting Range | |
|---|---|---|---|---|---|---|---|---|---|---|---|---|
| | %Au | %Ag | %Cu | %Zn | %Co | a* | b* | L* | Annealed | Age-Hardened | Solidus °C | Liquidus °C |
| 1 | 58.5 | 0 | 40.7 | 0.8 | 0 | 8.8 | 14 | 86 | 140 | 145 | 940 | 965 |
| 2 | 58.5 | 12.1 | 0 | 2.74 | 0.4 | 2.9 | 19.5 | 84 | 170 | 250 | 830 | 870 |

Table No. 3

| Alloy No. | Composition | | | | | | Color | | | Hardness (VHN) | | Melting Range | |
|---|---|---|---|---|---|---|---|---|---|---|---|---|---|
| | %Au | %Ag | %Cu | %Zn | %Co | %Ir | a* | b* | L* | Annealed | Age-Hardened | Solidus °C | Liquidus °C |
| 11 | 75.2 | 7 | 17.5 | 0 | 0.3 | 0 | 6.1 | 20.5 | 86.5 | 175 | 250 | 888 | 909 |
| 12 | 75.2 | 7 | 17.195 | 0.2 | 0.4 | 0.005 | 6.0 | 20.3 | 86.5 | 178 | 255 | 885 | 905 |

Table No. 2

| Alloy No. | Composition | | | | | | Color | | | Hardness (VHN) | | Melting Range | |
|---|---|---|---|---|---|---|---|---|---|---|---|---|---|
| | %Au | %Ag | %Cu | %Zn | %Co | %Ir | a* | b* | L* | Annealed | Age-Hardened | Solidus °C | Liquidus °C |
| 3 | 58.5 | 8 | 32.9 | 0.2 | 0.4 | 0 | 6.9 | 17.4 | 86.5 | 164 | 186 | 865 | 904 |
| 4 | 58.5 | 9 | 31.9 | 0.2 | 0.4 | 0 | 6.4 | 17.6 | 86.2 | 175 | 221 | 861 | 899 |
| 5 | 58.5 | 10 | 30.9 | 0.2 | 0.4 | 0 | 6.5 | 18.8 | 86.6 | 171 | 230 | 855 | 890 |
| 6 | 58.5 | 10 | 30.895 | 0.2 | 0.4 | 0.005 | 6.5 | 18.8 | 86.6 | 174 | 250 | 855 | 890 |
| 7 | 58.5 | 11 | 30 | 0.2 | 0.3 | 0 | 6.1 | 18.4 | 86.8 | 170 | 250 | 851 | 887 |
| 8 | 58.5 | 12 | 29.1 | 0 | 0.4 | 0 | 5.2 | 18.8 | 86.7 | 182 | 262 | 848 | 889 |
| 9 | 58.5 | 12 | 28.9 | 0.2 | 0.4 | 0 | 5.4 | 19.1 | 87.2 | 181 | 275 | 848 | 880 |
| 10 | 58.5 | 15 | 25.9 | 0.2 | 0.4 | 0 | 4.3 | 20.1 | 88.4 | 160 | 250 | 838 | 866 |

ROSE-COLORED GOLD ALLOY COMPOSITIONS WITH REVERSIBLE HARDNESS CHARACTERISTICS

TECHNICAL FIELD

The present invention relates generally to gold alloy compositions, and, more particularly, to improved 14-karat and 18-karat rose-colored gold alloy compositions having reversible hardness characteristics between their respective annealed- and age-hardened values.

BACKGROUND ART

Traditionally, 14- and 18-karat gold alloy compositions have been used in the manufacture of various items of jewelry, such as bracelets, necklaces, rings, and the like.

Some gold alloys have been developed that offer the capability of reversibility, by selective application of an appropriate heat treatment, between their annealed-hardness and aged-hardness values. In many cases, there is a considerable difference between these hardness values. Hence, an alloy may be annealed to lower its hardness value. This allows the alloy to be worked more easily. After the alloy has been worked, and the article thereof formed or repaired, the article may be aged-hardened to a higher hardness value to increase its resistance to denting and deformation. However, if there is a subsequent need to rework or repair the item, it may be annealed to reduce its hardness back down to its annealed-hardness value. After the item has been reworked or repaired, it may be aged-hardened to increase its hardness to a higher hardness value. Thus, by selectively heating and cooling these alloy compositions, the hardness of these compositions may be selectively varied. It is known to produce yellow (e.g., U.S. Pat. Nos. 5,180,551 and 6,676,776), white (e.g., U.S. Pat. No. 5,919,320) and green (e.g., U.S. Pat. No. 6,406,568) alloy compositions having such reversible hardness characteristics.

Grain structure is another characteristic that materially affects the value of an alloy. It has been known to add iridium, cobalt and/or nickel to produce an alloy having a fine grain structure. However, the use of these additives have to be closely controlled for fear of separation of these elements or formation of "hard spots" in the alloy. Nickel is a known cause of an allergic reaction with the skin that results in dermatitis. The use of these various grain refiners is discussed in Ott, "Optimizing Gold Alloys for the Manufacturing Process", Gold Technology, Issue No. 34 (Spring 2002) [at pp. 37-44].

Other gold alloy compositions are shown and described in U.S. Pat. Nos. 5,173,132 and 5,749,979. The aforesaid articles and each of the aforesaid patents are hereby incorporated by reference.

It would be generally desirable to provide rose-colored gold alloy compositions having hardnesses that are capable of being selectively varied between their respective annealed-hardness and age-hardness values.

DISCLOSURE OF THE INVENTION

The present invention broadly provides 14-karat and 18-karat rose-colored gold alloy compositions having hardnesses that may be selectively, controllably and reversibly varied between their respective annealed-hardness and age-hardened values.

The color of gold alloy compositions is no longer a matter of subjective impression. Rather, color is now determined objectively in terms of its component colors, a* (red-green) and b* (blue-yellow) and L* (brightness) on a CieLab color-measuring system. This method of measuring color is described in G. Raykhtsaum et al., "The Color of Gold", A. J. M (October 1994). While color is now measured objectively, the consumer appeal of a particular color or tint is still subjective.

In one aspect, the invention provides various 14-karat rose-colored gold alloy compositions that include: about 58.5% gold; about 9.0-12.0% silver; about 0.0-0.2% zinc; about 0.3-0.4% cobalt; about 0.0-0.02% iridium; about 29.0-33.0% copper; wherein the hardness of such compositions is capable of being selectively changed between its annealed-hardness value (i.e., obtained by heating the composition to about 1150° F. for about thirty minutes followed by a water quench) and its age-hardness value (i.e., obtained by heating the composition to about 600° F. for about one and one-half hours and thereafter allowing such composition to cool in a non-oxidizing atmosphere); and wherein the color of such compositions is between about 5-7 CieLab a* color units and between about 17-21 CieLab b* color units.

In the preferred compositions, the annealed-hardness value is between about 160-185 VHN, and the age-hardness value is at least about 220 VHN.

In another aspect, the invention provides an 18-karat rose-colored gold alloy compositions that include: about 75.2% gold; about 7.0% silver; about 0.0-0.2% zinc; about 0.3-0.4% cobalt; about 0.0-0.02% iridium; about 17.0-17.5% copper; wherein the hardness of such compositions is capable of being selectively changed between its annealed-hardness value (i.e., obtained by heating the composition to about 1150° F. for about thirty minutes followed by a water quench) and its age-hardness value (i.e., obtained by heating the composition to about 550° F. for about one and one-half hours and thereafter allowing such composition to cool in a non-oxidizing atmosphere); and wherein the color of such compositions is between about 5-7 CieLab a* color units and between about 17-21 CieLab b* color units.

Here again, in the preferred compositions, the annealed-hardness value is between about 160-185 VHN, and the age-hardness value is at least about 220 VHN.

Accordingly, the general object of the invention is to provide improved rose-colored gold alloy compositions.

Another object is to provide improved rose-colored gold alloy compositions having hardnesses that may be selectively, controllably and reversibly varied between their respective annealed-hardness and age-hardened values.

These and other objects and advantages will become apparent from the foregoing and ongoing written specification, the drawings, and the appended claims.

BRIEF DESCRIPTION OF THE DRAWINGS

Table 1 is a table showing the composition, color and hardness characteristics of two prior art 14-karat gold alloy compositions.

Table 2 is a table showing the composition, color and hardness characteristics of eight 14-karat gold alloy compositions, some of which have been found to be acceptable.

Table 3 is a table showing the composition, color and hardness characteristics of two improved 18-karat gold alloy compositions.

Figure 1:
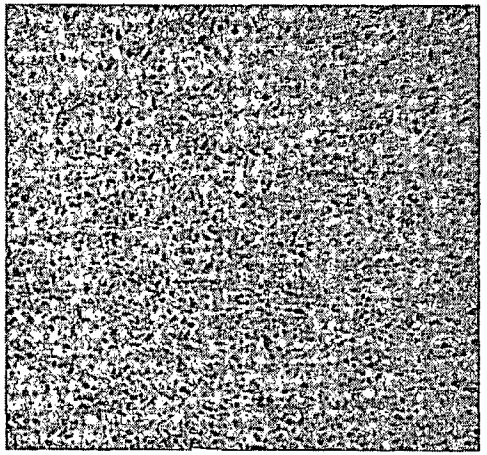

FIG. 1 is a photomicrograph, taken at a magnification of 75×, showing Alloy No. 6 after having been annealed to about 1000° F., this view showing the average grain size as being about 5 microns.

Figure 2:
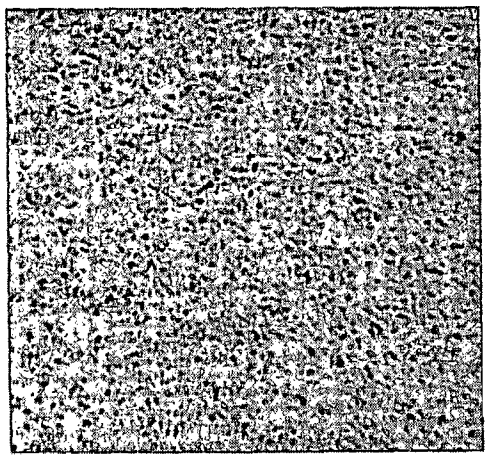

FIG. 2 is a photomicrograph, taken at a magnification of 75×, showing Alloy No. 6 after having been annealed to about 1100° F., this view showing the average grain size as being approximately 10 microns.

Figure 3:
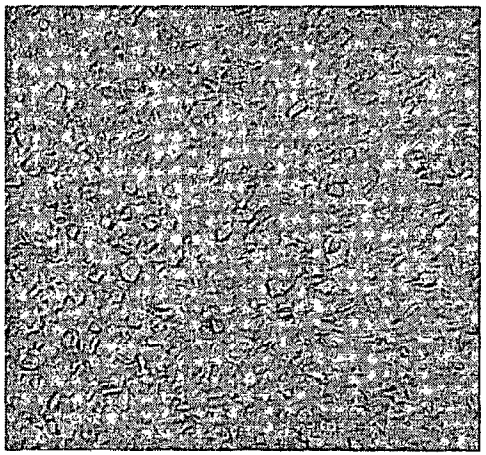

FIG. 3 is a photomicrograph, again taken at a magnification of 75×, showing Alloy No. 6 after having been annealed to 1200° F., this view illustrating the average grain size as being about 20 microns.

Figure 4:
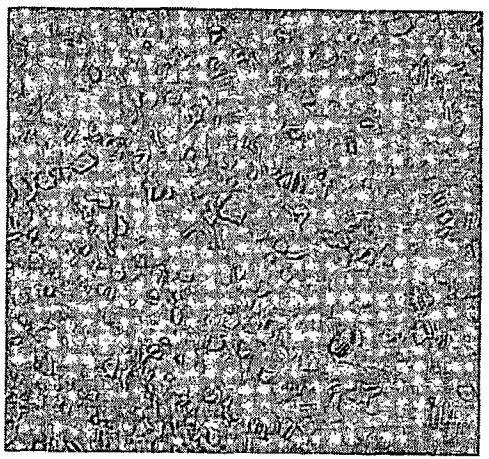

FIG. 4 is a photomicrograph, again taken at a magnification of 75×, showing Alloy No. 6 after having been annealed to 1250° F., this view showing the average grain size as being approximately 25 microns.

Figure 5:
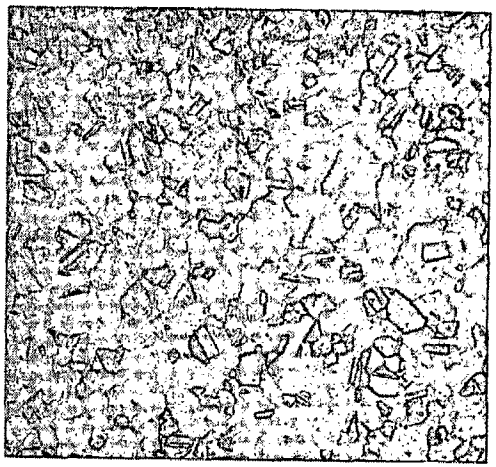

FIG. 5 is a photomicrograph, again taken at 75×, showing Alloy No. 5, after having been annealed at 1250° F., this view showing the average grain size as being approximately 45 microns.

Figure 6:
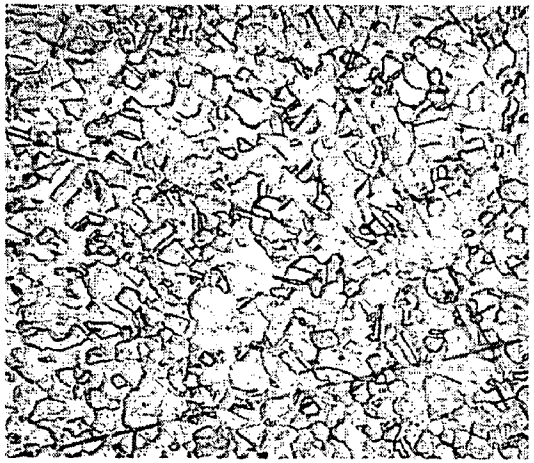

FIG. 6 is a photomicrograph, taken at a magnification of 75×, showing Alloy No. 11, after having been annealed at 1250° F., this view showing the average grain size as being about 45 microns.

Figure 7:
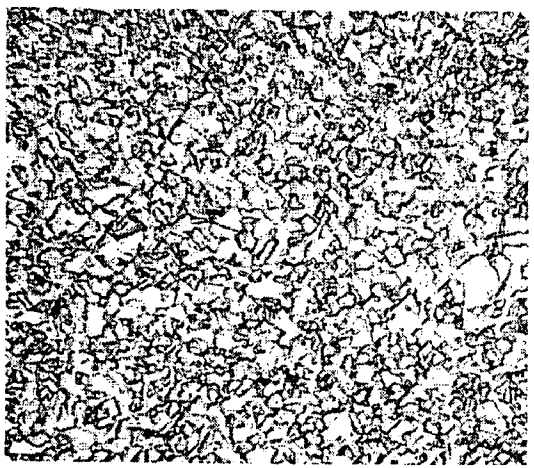

FIG. 7 is a photomicrograph, taken at a magnification of 75×, showing Alloy No. 12, after having been annealed at 1250° F., this view showing the average grain size as being about 25 microns.

DESCRIPTION OF THE PREFERRED EMBODIMENTS

The present invention broadly provides improved 14-karat and 18-karat rose-colored gold alloy compositions having hardnesses that are selectively, controllably and reversibly variable between their respective annealed-hardness values and age-hardness values.

Two prior art gold alloy compositions are shown in Table No. 1, which is provided in the drawings. In Table No. 1, the column headings are for Alloy No.; alloy composition in terms of percentage of gold (% Au), silver (% Ag), copper (% Cu), zinc (% Zn) and cobalt (% Co); color in terms of CieLab a*, b* and L* units; hardness, both annealed an age-hardened, in terms of Vickers Hardness Number (VHN); and melting range in terms of the Solidus and Liquidus temperatures, both expressed in ° C.

Alloy No. 1 has been commercially available for some time. It contains mainly gold and copper, and has a reddish-copper color. However, it is not heat treatable, and does not have reversible hardness characteristics.

Alloy No. 2 is similar to the alloys that are disclosed in U.S. Pat. No. 5,180,551. It has reversible hardening characteristics, but its red color component is only 2.9, and the resulting alloy is predominately yellow in color.

Eight additional 14-karat gold alloy compositions are listed in Table No. 2, which is provided in the drawings. In Table No. 2, the column headings are for Alloy No.; alloy composition in terms of percentage of gold (% Au), silver (% Ag), copper (% Cu), zinc (% Zn), cobalt (% Co) and iridium (% In); color in terms of CieLab a*, b* and L* units; hardness, both annealed an age-hardened, in terms of Vickers Hardness Number (VHN); and melting range in terms of the Solidus and Liquidus temperatures, both expressed in ° C.

Alloy No. 3 has an acceptable color, but the hardening behavior of this alloy was found to be unacceptable. Alloys No. 4-9 have acceptable color and the reversibility of their hardnesses is also acceptable.

Alloy No. 10 has acceptable hardness characteristics, but does not have the desirable color characteristics.

All of the improved alloys contain from about 0.3 to about 0.4% cobalt. The addition of cobalt improves the hardening characteristics, and provides the alloy composition with a fine grain structure. The grain structure may be further refined by the addition of about 0.005% iridium. Grain size of an item is also dependent on the final annealing temperature. In general, lower annealing temperatures result in finer grain structures.

FIGS. 1-4 shows the results of annealing temperature on grain size dependents for Alloy No. 6, which contains 0.005% iridium. In all three photomicrographs, the composition is the same. The only difference is the temperature at which the composition has been annealed. Thus, as shown in FIG. 1, if the alloy is annealed at about 1000° F., the average grain size will be approximately 5 microns.

However, as shown in FIG. 2, if the same alloy is annealed at 1100° F., the average grain size is increased to approximately 10 microns.

FIG. 3 shows the same alloy composition having been annealed to 1200° F., with the average grain size being about 20 microns.

FIG. 4 shows the same alloy composition annealed at 1250° F., with the average grain size being about 25 microns. Thus, FIGS. 1-4 illustrate grain size increases in direct correlation to the annealing temperature.

FIG. 5 shows the effect of the addition of 0.005% iridium. It should be noted that Alloys 5 and 6 are substantially the same, but for the addition of 0.005% iridium to Alloy No. 6. FIG. 4 shows that when Alloy No. 6 was annealed at 1250° F., the average grain size was approximately 25 microns. FIG. 5, in contrast, shows that Alloy No. 5 (which has substantially the same composition as Alloy No. 6 except for the presence of iridium), when annealed at 1250° F., produced a grain structure of about 45 microns, almost twice the grain size shown to exist when Alloy No. 6 was annealed at the same temperature. Thus, it appears that the addition of a small amount of iridium reduces the average grain size substantially.

Two improved 18-karat gold alloy compositions are listed in Table No. 3, which is also provided in the drawings. In Table No. 3, the column headings are for Alloy No.; alloy composition in terms of percentage of gold (% Au), silver (% Ag), copper (% Cu), zinc (% Zn), cobalt (% Co) and iridium (% In); color in terms of CieLab a*, b* and L* units; hardness, both annealed an age-hardened, in terms of Vickers Hardness Number (VHN); and melting range in terms of the Solidus and Liquidus temperatures, both expressed in ° C.

FIG. 6 is a photomicrograph, taken at a magnification of 75×, showing Alloy No. 11, after having been annealed at 1250° F., this view showing the average grain size as being about 45 microns.

FIG. 7 is a photomicrograph, taken at a magnification of 75×, showing Alloy No. 12, after having been annealed at 1250° F., this view showing the average grain size as being about 25 microns. This micrograph shows the effect of iridium on reducing the average grain size.

Therefore, the present invention provides various rose-colored gold alloy compositions having hardnesses that may be selectively, controllably and reversibly varied between their respective annealed-hardness values and their respective age-hardness values.

The improved 14-karat rose-colored gold alloy compositions include: about 58.5% gold; about 9.0-12.0% silver; about 0.0-0.2% zinc; about 0.3-0.4% cobalt; about 0.0-0.02% iridium; about 29.0-33.0% copper; wherein the hardness of such compositions is capable of being selectively changed between its annealed-hardness value (i.e., obtained by heating the composition to about 1150° F. for about thirty minutes followed by a water quench) and its age-hardness value (i.e., obtained by heating the composition to about 600° F. for about one and one-half hours, and thereafter being allowed to cool in a non-oxidizing atmosphere); and wherein the color of such compositions is between about 5-7 CieLab a* color units in between about 17-21 CieLab b* color units. The annealed-hardness value may be between 160-185 VHN and the age-hardness value may be at least about 220 VHN.

The improved 18-karat rose-colored gold alloy compositions include: about 75.2% gold; about 7.0% silver; about 0.0-0.2% zinc; about 0.3-0.4% cobalt; about 0.0-0.02% iridium; about 17.0-17.5% copper; wherein the hardness of such compositions is capable of being selectively changed between its annealed-hardness value (i.e., obtained by heating the composition to about 1150° F. for about thirty minutes followed by a water quench) and its age-hardness value (i.e., obtained by heating the composition to about 550° F. for about one and one-half hours, and thereafter being allowed to cool in a non-oxidizing atmosphere); and wherein the color of such compositions is between about 5-7 CieLab a* color units and between about 17-21 CieLab b* color units.

Here again, the annealed-hardness values are between about 160-185 VHN, and the age-hardness values of this composition are at least about 220 VHN.

Modifications

The present invention contemplates that many changes and modifications may be made. For example, the various components may be modified within the ranges generally set forth in the appended claims. Also, the annealing and age-hardening temperatures and times may be varied within the parameters of normal experimentation, as will occur to a person skilled in this art.

All actual values indicated in Tables 1-3 closely approximate the indicated numerical value.

Therefore, while various improved compositions have been shown and described, and several modifications thereof discussed, persons skilled in this art will readily appreciate that various additional changes and modifications may be made without departing from the spirit of the invention, as defined and differentiated by the following claims.

What is claimed is:

1. A 14-karat rose-colored gold alloy composition, comprising:

about 58.5% gold;

about 9.0-12.0% silver;

about 0.0-0.2% zinc;

about 0.3-0.4% cobalt;

about 0.0-0.02% iridium;

about 29.0-33.0% copper;

wherein the hardness of said composition is capable of being selectively changed between its annealed-hardness value, obtained by heating the composition to about 1150° F. for about thirty minutes followed by a water quench, and its age-hardness value, obtained by heating said composition to about 600° F. for about one and one-half hours and thereafter being allowed to cool in a non-oxidizing atmosphere; and wherein the color of said composition is between about 5-7 CieLab a* color units and between about 17-21 CieLab b* color units.

2. The composition as set forth in claim 1 wherein said annealed-hardness value is between about 160-185 VHN.

3. The composition as set forth in claim 1 wherein said age-hardness value is at least about 220 VHN.

4. A 14-karat rose-colored gold alloy composition, consisting essentially of:

about 58.5% gold;

about 9.0-12.0% silver;

about 0.0-0.2% zinc;

about 0.3-0.4% cobalt;

about 0.0-0.02% iridium;

about 29.0-33.0% copper;

wherein the hardness of said composition is capable of being selectively changed between its annealed-hardness value, obtained by heating the composition to about 1150° F. for about thirty minutes followed by a water quench, and its age-hardness value, obtained by heating said composition to about 600° F. for about one and one-half hours and thereafter being allowed to cool in a non-oxidizing atmosphere; and wherein the color of said composition is between about 5-7 CieLab a* color units and between about 17-21 CieLab b* color units.

5. The composition as set forth in claim 4 wherein said amended-hardness value is between about 160-185 VEIN.

6. The composition as set forth in claim 4 wherein said age-hardness value is at least about 220 VHN.

* * * * *